United States Patent [19]

Dowdle

[11] Patent Number: 4,509,039

[45] Date of Patent: Apr. 2, 1985

[54] SHIELDED, CLOSELY SPACED TRANSMIT-RECEIVER ANTENNAS FOR ELECTRONIC ARTICLE SURVEILLANCE SYSTEM

[75] Inventor: Dean M. Dowdle, White Bear Lake, Minn.

[73] Assignee: Minnesota Mining and Manufacturing Company, St. Paul, Minn.

[21] Appl. No.: 510,780

[22] Filed: Jul. 5, 1983

[51] Int. Cl.[3] ..... G08B 13/24; H01Q 7/04

[52] U.S. Cl. ..... 340/572; 343/842

[58] Field of Search ..... 340/572; 343/6.8 R, 343/6.8 LC, 842

[56] References Cited

U.S. PATENT DOCUMENTS

| | | | |
|---|---|---|---|
| 3,740,742 | 6/1973 | Thompson et al. | 340/572 |
| 3,810,147 | 5/1974 | Lichtblau | 340/572 |
| 3,810,172 | 5/1974 | Burpee et al. | 343/5 PD |
| 4,023,167 | 5/1977 | Wahlstrom | 343/6.5 SS |
| 4,251,808 | 2/1981 | Lichtblau | 340/572 |
| 4,373,163 | 2/1983 | Vandebult | 343/842 |
| 4,394,645 | 7/1983 | Humble et al. | 340/572 |

*Primary Examiner*—James J. Gill

*Attorney, Agent, or Firm*—Donald M. Sell; James A. Smith; William B. Barte

[57] ABSTRACT

A shielded, closely spaced transmit-receiver system for use in an electronic article surveillance system is disclosed wherein at least one of the antennas is provided with at least two twisted loops lying in a common plane each loop being twisted 180° to be in phase opposition with the adjacent loop and wherein both antennas are substantially enclosed by a conductive shield having a discontinuity in an outer portion enclosing each of the twisted loops.

7 Claims, 7 Drawing Figures

SHIELDED, CLOSELY SPACED TRANSMIT-RECEIVER ANTENNAS FOR ELECTRONIC ARTICLE SURVEILLANCE SYSTEM

FIELD OF THE INVENTION

This invention relates to an electronic article surveillance system and more particularly to the transmitreceive antennas utilized therewith.

BACKGROUND OF THE INVENTION

Electronic article surveillance systems are now commonly known for enabling the detection of the unauthorized removal of articles having some form of detectable marker secured thereto. Particular importance to the present invention, one type of such systems utilizes a radio frequency energy which is radiated into an interrogation zone along which articles having an electrically resonant circuit secured thereto must pass. Such a circuit absorbs energy from the field and reemits energy at its resonant frequency. Such reemitted energy is then detected by the receiver and an alarm produced as appropriate. For example, such systems are described in U.S. Pat. Nos. 3,810,147, 3,810,172, 3,740,742, and 4,023,167. In the systems there disclosed, two generally planar loop antennas are usually employed, one for transmitting and one for receiving, with each of the loop antennas generally being placed on opposite sides of an interrogation zone. Such a configuration will be recognized to complicate installation procedures.

It has further been noted that unshielded antenna configurations such as disclosed in the aforesaid patents are susceptible to external electrical noise often present in many commercial and industrial environments. Such noise is thus often picked up by the receiver antennas and confused with the low level signals produced by a marker circuit. In some cases, external noise may even directly interfere with, or load the transmitter antenna, such that improper transmit signals are produced. One attempt to minimize such interference effects is depicted in U.S. Pat. No. 4,251,808, the specification of which is incorporated herein by reference. In the system depicted therein, however, transmit and receive antennas are positioned on opposite sides of a exit way, with an electrostatic shield substantially enclosing only such antennas as include two or more twisted loops lying in a common plane. While the specification thereof notes that a single loop antenna may include an electrostatic shield wherein at least one discontinuity is provided to prevent current from circulating in the shield itself, the specification does not suggest the use of such a shield enclosing both an open loop and antennas having at least one pair of twisted loops.

SUMMARY OF THE INVENTION

In accordance with the present invention, an antenna system is provided for use in an electronic article surveillance system having transmitter means for providing an electromagnetic field in a predetermined area, at at least one of a plurality of frequencies extending through a predetermined range of frequencies, a marker circuit having at least one resonant frequency within the predetermined range of provided frequencies, and receiver means for detecting the presence of the marker circuit in the electromagnetic field and for providing an alarm indication thereof. In the antenna system of the present invention, there is provided a transmitting antenna coupled to the transmitter means, a receiving antenna coupled to the receiver means, both of such antennas being disposed in a closely spaced, generally parallel and hence planar relationship on one side of an exit way along which a marker circuit must pass for detection. Both of the transmitting and receiving antennas have substantially the same area and are magnetically nulled to minimize mutual inductance. Furthermore, as set forth in the above noted U.S. Pat. No. 4,251,808, at least one of the antennas is provided with at least two twisted loops lying in a common plane, each loop being twisted 180° to be in phase opposition with each adjacent loop, thereby causing net voltages to be induced in each of the loops, such as may be provided by distant electromagnetic fields, to cancel each other. Further, the antenna system includes a conductive shield enclosing substantially all of both of the closely spaced antennas, in which a discontinuity is provided in each outer portion which encloses a twisted loop. A conductive shield is thus provided for both the transmit and receive antennas, which prevents external electric fields from capacitively coupling or otherwise inducing current flow in either antenna which could otherwise destroy the null created therebetween and hence adversely effect the detection of the marker circuit.

In a preferred embodiment, each of the transmitting and receiving antennas have substantially rectangular configurations, the receiving antenna including a single turn coil having substantially the same dimensions as the outer dimensions of the figure-8 transmitting antenna. It is particularly desirable that the shield provided with such rectangular configured transmitting and receiving antennas include an extruded channel assembly, such as may conveniently be formed from extruded aluminum. Such a channel may desirably have a generally U-shaped cross section, being open along substantially one entire side to allow ready insertion of the transmitting and receiving antennas. In such an embodiment a generally planar cover, such as may also be formed from extruded aluminum, is adapted to mate with the open side to enclose the antennas. It is further desired that such an extruded channel assembly may include a center portion to which a housing means may be secured, which housing means may enclose electrical circuitry associated with the transmitter and receiver means, thereby providing a substantially stand-alone system, while also enclosing the cross-over portion of the figure-8 transmit antenna.

Such an antenna system provides a number of advantages over prior art systems. Both antennas are positioned together, and thus may be located on one side of an interrogation zone, thereby greatly enhancing the ease with which such an electronic article surveillance system may be installed, while also greatly minimizing the conspicuousness of such a system. Further, the system provides significant improvement in the electrical operation thereof, as the close spacing of the transmit and receive antennas significantly increases the sensitivity to markers over that obtained with separately positioned transmit and receive antennas. The ability to enclose both the transmit and receive antennas within a single shield also results in a significant economy in construction. Furthermore, the inclusion of the electronic circuitry within a housing forming a part of the shield assembly reduces the effects of ambient noise and hence results in lower background noise in the receiver.

DETAILED DESCRIPTION

Figure 1:
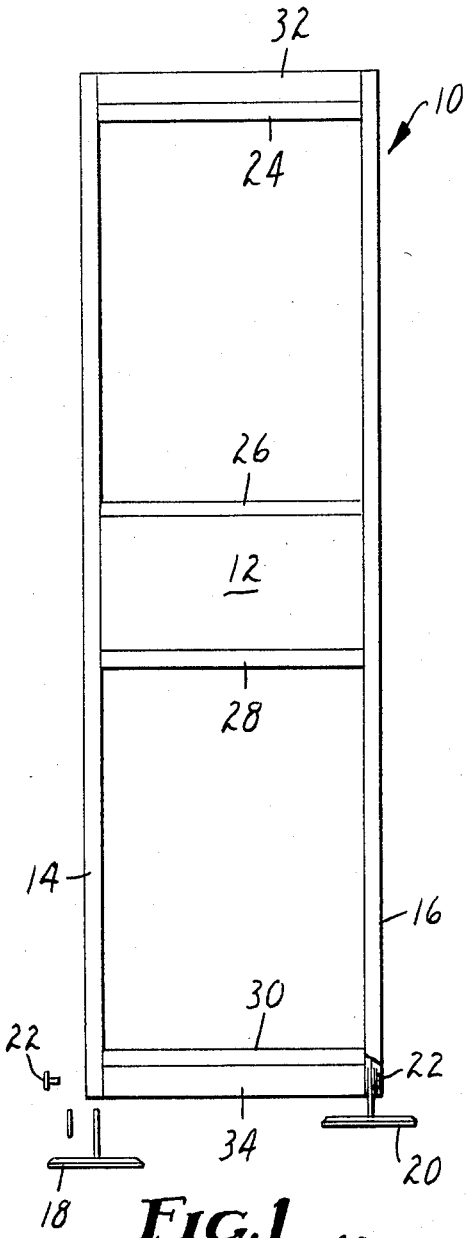
FIG. 1 is a frontal view of the antenna system of the present invention.

As set forth in FIG. 1, the antenna system of the present invention preferably forms a part of a panel assembly 10 adapted to be placed on one side of an exit way along which articles carrying a marker to be detected in an article surveillance system are required to pass. The assembly 10 is thus substantially planar in nature, being formed of, for example, extruded aluminum channels approximately one inch thick. The overall assembly 10 preferably extends approximately 18 inches wide and is approximately 60 inches high. The assembly 10 has enclosed within the channels, transmit and receiver antennas as to be described hereinbelow and has located within a centrally located housing 12 electronic circuitry associated with the transmitter and receiver means of the electronic article surveillance system itself. The vertical members 14 and 16 of the assembly are further fitted with pedestals 18 and 20 having vertical projections adapted to be received within recesses in the vertical members 14 and 16, and to be secured therein by means of concealed mounting screws 22. Each of the pedestals 18 and 20 are further adapted to be secured to the floor adjacent an exit way upon installation of the assembly.

Figure 3:
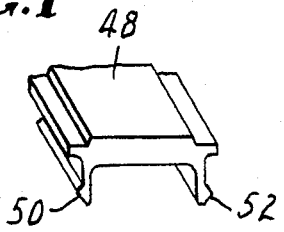
FIG. 3 is a perspective of a cover member used in the antenna system of FIG. 1.
Figure 2:
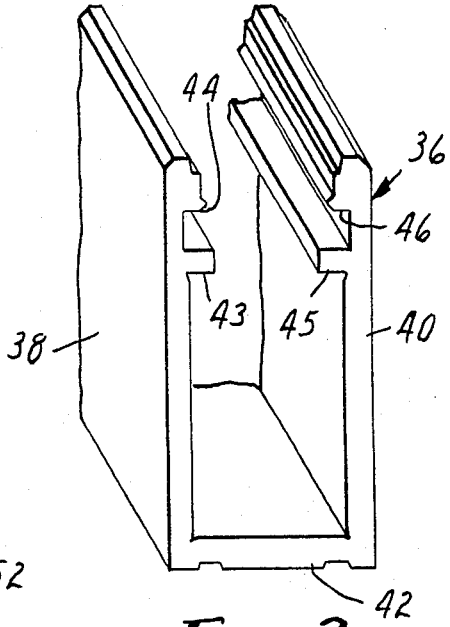
FIG. 2 is a perspective view of one channel member used in the shield portion of the antenna system shown in FIG. 1.

In addition to the vertical members 14 and 16, the assembly 10 further includes horizontal members 24, 26, 28, and 30 which are formed of similar dimension extruded channel together with top and bottom support members 32 and 34 which are formed of larger cross-sectional channel. Thus as shown in FIG. 2, the large cross-sectional horizontal support members 32 and 34 are formed of an extruded channel material 36 having the side walls 38 and 40 joined to a base 42. The channel 36 is open opposite the base 42, thereby enabling ready access into the cavity within the channel. Each of the walls 40 and 38 in the region adjacent the opening are appropriately configured, including recesses 44 and 46 to mate with a cover member 48 shown in perspective view in FIG. 3. The cover member is dimensioned to provide a snap fit into the opening in the U-shaped channel to substantially seal the enclosure. The outer resultant surface formed by the mated vertical members 40 and 38 together with the cover member 48 is substantially identical to the outer surface of the base 42, there being identical recessed portions which both provide a decorative appearance and also conceal the mating line between the vertical walls 36 and 38 and the cover member 48. As shown in FIG. 3, the cover member includes projecting members 50 and 52 adapted to mate with the recesses 44 and 46 respectively within the side walls 40 and 38 when the cover member is snapped into place.

Figure 4:
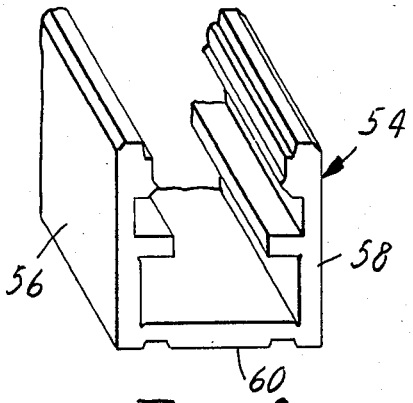
FIG. 4 is a perspective view of another channel member used in the antenna system of FIG. 1.

FIG. 4 is a cross sectional view of the square cross section channel members used in the vertical members 14 and 16 and interior horizontal members 24, 26, 28 and 30 respectively as shown in FIG. 1. Aside from the difference in cross sectional profile, the construction is similar to that of FIG. 2 such that there are included side walls 56 and 58, a base member 60 opposite of which is an opening having appropriately configured adjacent walls to receive a cover member 48.

The larger cross sectional area top and bottom members 32 and 34 are provided primarily to provide structural stability to the overall assembly. Thus, for example, the rectangular cavity extending between the base 42 and the internal ribs 43 and 45 on each of the walls 40 and 38 respectively, may be filled with a close fitting block of seasoned hardwood cut flush with the ends of each of the sections 32 and 34. Upon assembly, the vertical members 14 and 16 are assembled with the open portion of the U-shaped channel facing outwards, such that appropriately dimensioned wood screws may be mounted through the base 42 of each of the side rails and secured firmly into the wood blocks inserted within each of the horizontal support members 32 and 34. As thus assembled, an extremely rigid structure results.

In contrast to the filled support members 32 and 34, the interior horizontal members 24, 26, 28, and 30 respectively are mounted such that the open side of each of the respective channel members is accessible. Thus, for example, the top and bottom of the interior members 24 and 30 are secured to the top and bottom support members 32 and 34 by means of screws extending through the base 60 of each of the members 24 and 30 and into the support members 32 and 34. In contrast, the middle horizontal members 26 and 28 are not secured directly to the vertical members 14 and 16, and are, rather, secured to the housing assembly 12 which is in turn secured directly to the members 14 and 16.

Figure 5:
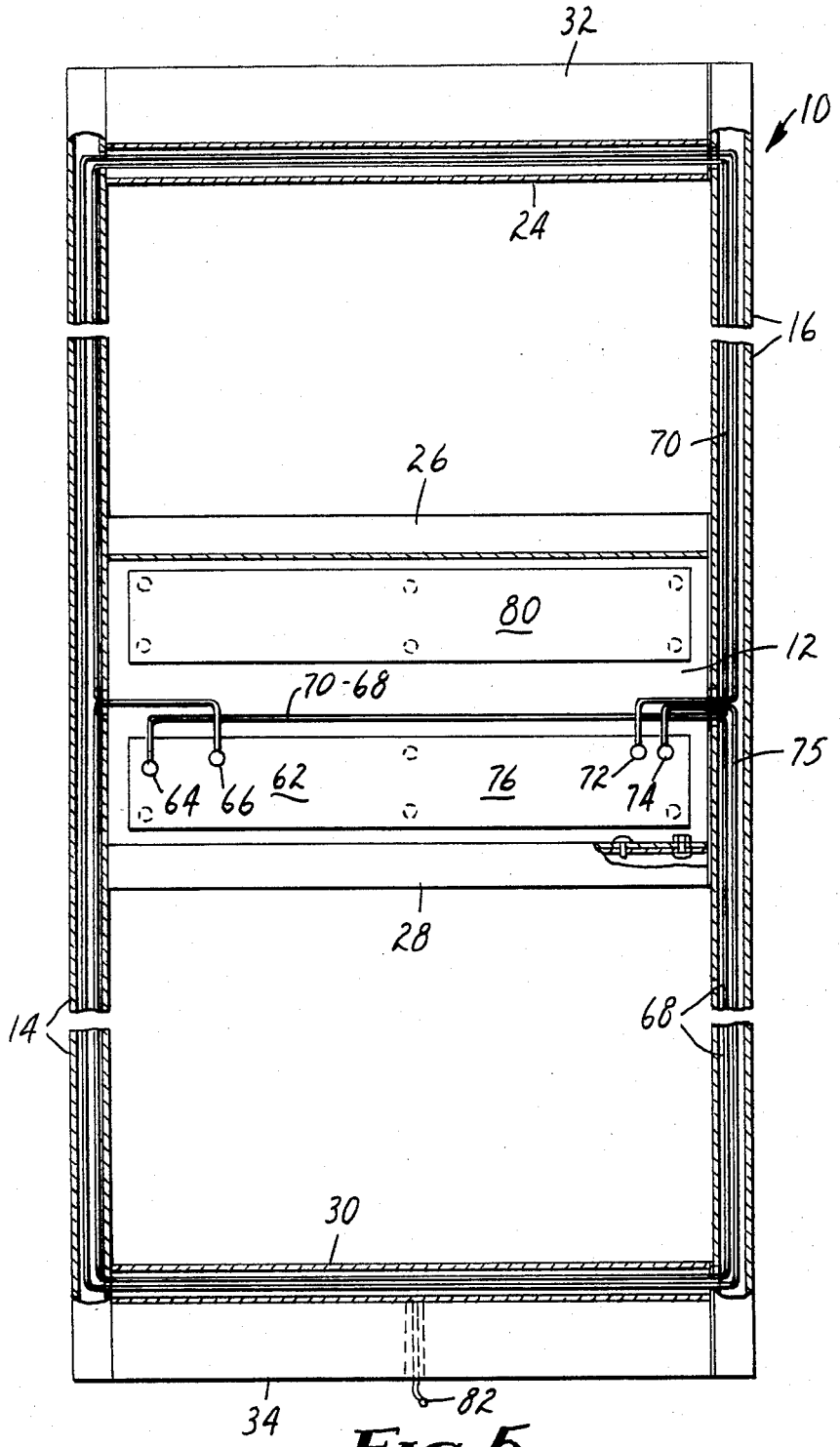
FIG. 5 is a frontal view of the antenna system shown in FIG. 1, with front panels removed allowing interior components to be seen.

FIG. 5 is another frontal view of the assembly 10 of FIG. 1, shown in partial disassembly with respective cover members removed, thereby exposing the transmit and receive antennas and electronic circuitry mounted within the housing 12. Additional structural details of the assembly are omitted for the sake of clarity. It may there be noted that the housing 12 preferably includes two half members each having substantially planar faces and turned up flanges adapted to meet together to form an enclosure having substantially the same depth as the width of the extruded members. Flanges on one of the halves are secured to the vertical members 14 and 16 through appropriate mounting screws secured through the bases 42 of those members. The interior horizontal extrusion members 26 and 28 are also similarly secured to opposing flanges of the same half of the housing. The opposite half of the housing is then secured to the horizontal members 26 and 28 by means of additional screws inserted through openings in the channels 26 and 28. It may thus be seen that upon completion of the assembly, insertion of the respective electronic components within the housing 12, and insertion of the transmit and receive antennas throughout the extruded members, the covers 48 may be snapped in place along all of the openings in the respective extrusions, thereby providing completely uninterrupted, smooth surfaces without any exposed screws or other mounting hardware such as would invite tampering when the assembly is located in a public or otherwise unsupervised area.

As noted above, at least one of the antennas of the present invention includes at least two twisted loops lying in a common plane, each loop being twisted 180° to be in phase opposition with the adjacent loop. As shown in FIG. 5, such a configuration is provided as a transmit antenna which is coupled to a transmitter portion 62 of a printed circuit board mounted within the housing 12. The figure-8 transmit coil includes two halves 68 and 70, each of which are coupled to mounting terminals 64 and 66 on the transmit circuit board 62. Thus one half of the transmit coil 68 is inserted within the lower half of each of the vertical members 14 and 16 and the bottom horizontal member 30, while the upper half of the transmit coil 70 extends through the upper half of each of the vertical members 14 and 16 and along the top horizontal member 24. In contrast, the receive antenna 75 is secured to two mounting terminals 72 and 74 within a receiver portion 76 of the printed circuit board mounted within the housing 12, and extends in a single open loop passing first along the lower portion of vertical member 16, along the bottom horizontal member 30, a lower portion of vertical member 14 along the upper portion of the member 14, along the upper member 24 and finally back to terminal 72 along the upper half of the vertical member 16. It may also be noted that an additional printed circuit board 80 is also mounted within the housing 12 on which the remainder of the detector electronics associated with the overall system may be mounted. By so including all of the electronics associated with the system, a totally self-contained system is provided wherein, and the only external connections required to be provided to the system are made by means of leads coupled through one vertical member and through appropriate openings through the bottom interior member 30 and bottom support member 34, terminating in a power cord or the like 82. It may also be noted that where more than one such system is to be used such as in a multi-aisle exit way and synchronization of the respective systems are desired, additional leads facilitating such synchronization may also be desirably coupled to the system by means of similarly positioned cables.

Figure 6:
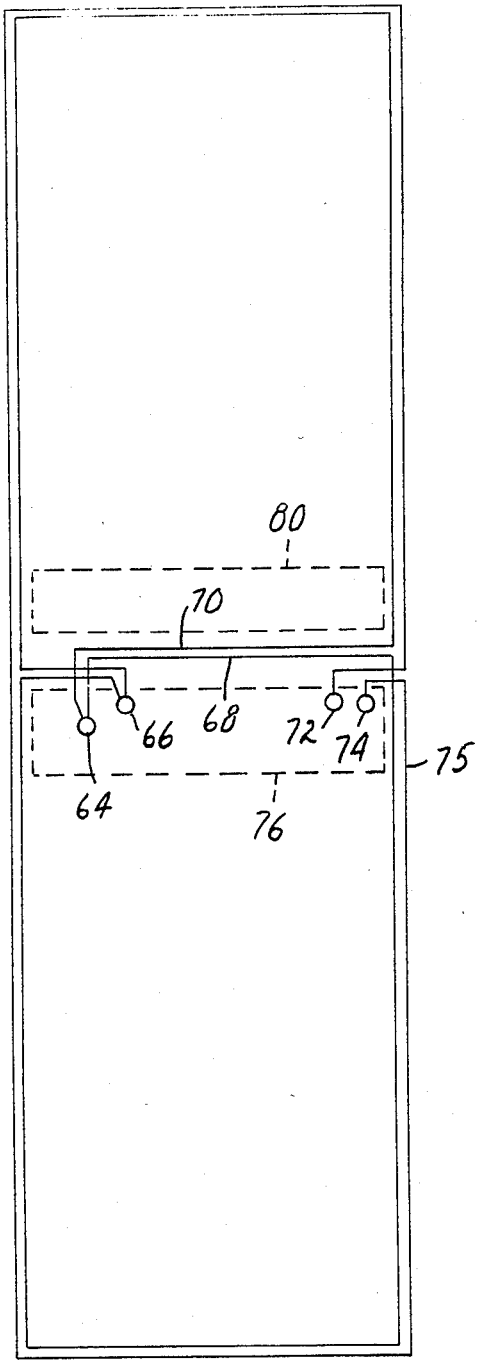
FIG. 6 is a frontal view of the transmitting and receiver antennas of the antenna system of FIG. 1.

A more unobstructed view of the transmit and receive antennas preferably used in the antenna system of the present invention is set forth in FIG. 6. As is there seen, the two halves 68 and 70 of the transmit antenna extend from mounting terminals 64 and 66, one half 68 extending around the lower half of the assembly while the other half 70 extends around the upper half of the assembly. By so coupling the two halves together it will be noted that each half forms one of two twisted loops which are connected in a 180° phase opposition. In contrast, the receive antenna 75 is formed as a single open loop and extends from terminal 72 entirely around the periphery of the assembly terminating at terminal 74.

Figure 7:
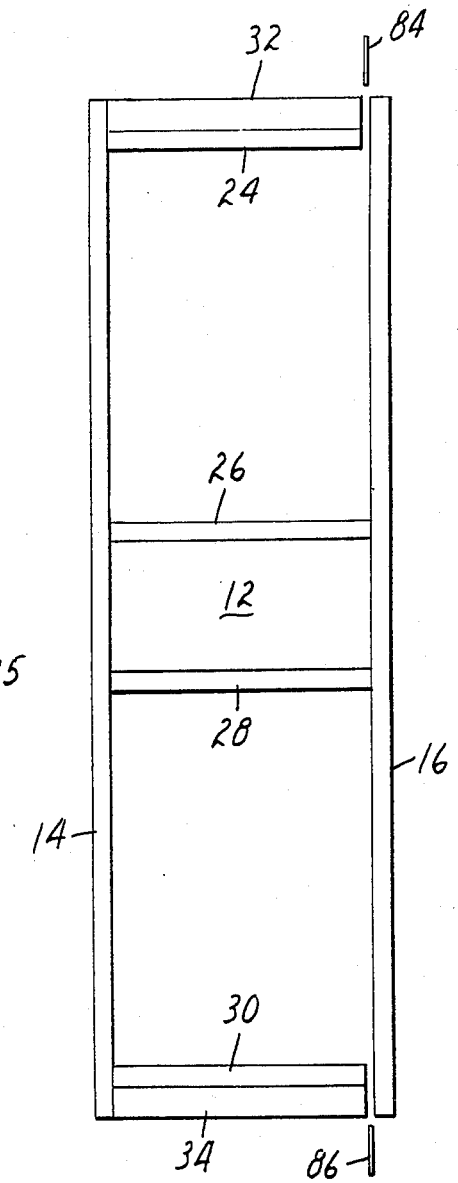
FIG. 7 is a frontal view of the shield components of the antenna system of FIG. 1.

Final details of the shield portion of the antenna system of the present invention are shown in FIG. 7, with both mounting details and electrical leads, antennas and the like removed for purposes of clarity. It may there be seen that the shield is provided with electrical discontinuities in the outer portions. The electrical discontinuities between each of the respective portions is conveniently provided by means of short sections of electrical insulating tape inserted between adjoining faces. Thus a section of tape 84 may be provided at the interface between the vertical member 16 and horizontal members 24 and 32 and another section 86 between the interface between the vertical member 16 and the bottom members 30 and 34.

It will, of course, be further recognized that where mechanical connections are necessarily made between adjacent portions which are to be electrically insulated from each other, that insulating washers and the like may be included.

While the assembly described hereinabove is particularly preferred inasmuch as it results in an extremely compact and esthetically pleasing assembly, it is recognized that various alternatives and variations thereof may be provided all of which are within the scope of the present invention. Thus, for example, the various extruded members need not be formed of extruded metal but may rather be formed of extruded rigid plastics and appropriate conductive surfaces be provided for shielding purposes, such as by coating one surface with a metallic foil or vapor coated metal films or the like. In the embodiment depicted above, single turn transmit and receive antennas are preferably utilized, each of which may be formed of 18 gauge stranded and insulated wire, such stranded wire being desired to minimize skin effects when radio frequencies are applied thereto. Other antenna configurations may similarly be employed. Also, for example, either or both of the transmit and receive antennas may include at least two or more twisted loops such as depicted in U.S. Pat. No. 4,251,808 referenced above. Other variations in the mounting of such antennas in order to minimize mutual inductance but wherein both the transmit and receive antennas are mounted within a common shield are similarly within the scope of the present invention. Finally, it may also be recognized that a variety of electrostatic shield configurations may be provided wherein electrical discontinuities between various portions of the shield are present. In all cases, of course, the important parameter is that no closed loop portions be presented within the shield so as to tend to repel magnetic fields attempting to pass through the shorted turn and thus through the loop antennas, which shorted turns would radically reduce the sensitivity of the loop antennas and completely alter either transmitting or receiving characteristics.

I claim:

1. For use in an electronic article surveillance system having transmitter means for providing an electromagnetic field in a predetermined area at at least one of a plurality of frequencies extending through a predetermined range of frequencies, a resonant marker circuit having at least one resonant frequency within said predetermined range of provided frequencies, and receiver means for detecting the presence of said marker circuit in said electromagnetic field and providing an alarm indication thereof, an antenna system comprising:

a transmitting antenna coupled to said transmitter means and a receiving antenna coupled to said receiver means, said antennas being disposed in a closely spaced, generally parallel relationship on one side of an exit-way along which a said marker circuit must pass for detection, said transmitting and receiving antennas each having substantially the same area and being magnetically nulled to minimize mutual inductance, at least one of said antennas having at least two twisted loops lying in a common plane, each loop being twisted 180° to be in phase opposition with each adjacent loop; and a conductive shield enclosing substantially all of both of the closely spaced antennas and including a discontinuity in each outer portion enclosing a said twisted loop to provide a discontinuous shield for both the transmit and receive antennas to prevent external electric fields from inducing current flow in either antenna which could otherwise destroy the null created therebetween and hence adversely effect the detection of said marker circuit.

2. An antenna system according to claim 1, wherein said transmitting antenna comprises a single turn, generally rectangular figure-8 configuration, said receiving antenna comprises a single turn coil having substantially the same dimensions as the outer dimensions of the transmitting antenna.

3. An antenna system according to claim 1, wherein said shield comprises an extruded channel having at least a conductive surface and having a generally U-shaped cross section, being open along substantially one entire side to allow ready insertion of said transmitting and receiving antennas, and having a generally planar conductive cover adapted to be received on the open side to enclose said antennas.

4. A system according to claim 3, wherein said channel and cover comprise matching surface portions adapted to mate together to provide a substantially sealed enclosure.

5. A system according to claim 3, wherein said shield comprises an assembly of members, each member being formed of said channel, access for said antennas extending from one channel member to another being provided by suitable openings through matching walls thereof.

6. A system according to claim 1, further comprising housing means secured to said shield for enclosing electrical circuitry therein associated with said transmitter and receiver means, to thereby provide a substantially stand-alone system, needing no external connection other than for input power.

7. A system according to claim 6, wherein said shield comprises an extruded channel having at least a conductive surface and having a generally U-shaped cross section being open along one side to allow ready insertion of said antennas and having a generally planar conductive cover adapted to enclose said open side, wherein said housing is secured substantially at the mid-section of said shield to allow the cross-over portion of said figure-8 antenna to be enclosed therein.

* * * * *